United States Patent [19]

Kinnan

[11] Patent Number: 4,697,959

[45] Date of Patent: Oct. 6, 1987

[54] METHOD AND APPARATUS FOR INSTALLING AN IN-GROUND SUPPORT FOOTING AROUND AN UPSTANDING ELONGATE OBJECT

[75] Inventor: Frank R. Kinnan, Camas Valley, Oreg.

[73] Assignee: Utilitech, Incorporated, Walnut Creek, Calif.

[21] Appl. No.: 763,145

[22] PCT Filed: Dec. 1, 1983

[86] PCT No.: PCT/US83/01878

§ 371 Date: Aug. 1, 1985

§ 102(e) Date: Aug. 1, 1985

[87] PCT Pub. No.: WO85/02435

PCT Pub. Date: Jun. 6, 1985

[51] Int. Cl.[4] ..... E02D 37/00

[52] U.S. Cl. ..... 405/232; 52/514; 37/2 R; 405/216; 175/394

[58] Field of Search ..... 405/231-253, 405/258, 269, 222, 223, 229, 216; 52/98, 514, 515, 296-298, 126.6, 126.7, 127.1, 127.2; 37/2 R; 175/244, 245, 247, 394, 58, 171; 254/201-205, 199, 207, 213, 214

[56] References Cited

U.S. PATENT DOCUMENTS

| | | | |
|---|---|---|---|
| 108,814 | 1/1870 | Moseley | 405/222 |
| 405,658 | 6/1889 | Campany . | |
| 715,362 | 12/1902 | Etheridge | 52/297 |
| 1,157,444 | 10/1915 | Stewart . | |
| 2,133,563 | 10/1938 | Parks et al. . | |
| 2,203,881 | 6/1940 | Schwab et al. . | |
| 2,237,383 | 4/1941 | Agostineto | 175/394 X |
| 2,775,428 | 12/1956 | Monthan . | |
| 2,897,553 | 4/1959 | Gorrow | 405/216 |
| 2,926,500 | 3/1960 | Hoppe | 405/257 X |
| 3,307,643 | 3/1967 | Ferri . | |
| 3,385,070 | 5/1968 | Jackson . | |
| 3,594,931 | 7/1971 | Yost | 37/2 R |
| 4,033,080 | 5/1977 | Fukushima | 52/223 R |
| 4,068,396 | 1/1978 | Langguth | 37/2 R |

FOREIGN PATENT DOCUMENTS

| | | |
|---|---|---|
| 2558219 | 7/1977 | Fed. Rep. of Germany . |
| 408090 | 3/1910 | France . |
| 86047 | 7/1957 | Netherlands . |
| 233372 | 4/1925 | United Kingdom . |

*Primary Examiner*—Dennis L. Taylor

*Attorney, Agent, or Firm*—Kolisch, Hartwell & Dickinson

[57] ABSTRACT

A method and apparatus for installing an in-ground support footing around subterranean and above-ground portions of an upstanding elongate object, such as a structural pole, post or the like, to enhance structural integrity thereof, includes providing a cylindrical casing of hollow construction having a cutting end concentrically positionable around a lower, above-ground region of the elongate object so that the cutting end engages the ground. A driver is then positionable about a circumferential portion of the casing means operable for engaging and rotating the casing means about its longitudinal axis while simultaneously imparting a downwardly-directed force against the upper edge of the casing means thereby to drive it in the ground to a predetermined depth. After the driving sequence has occurred, suitable stabilizing filler material is dispensed into a substantial portion of the relatively soil-free annulus which is created between the casing means and the corresponding exterior surface of the elongate object. The above sequence of establishing an in-ground support footing and the apparatus disclosed does not require that the elongate object be modified by replacement or cutting to establish a support footing over a "stump."

40 Claims, 16 Drawing Figures

METHOD AND APPARATUS FOR INSTALLING AN IN-GROUND SUPPORT FOOTING AROUND AN UPSTANDING ELONGATE OBJECT

BACKGROUND AND SUMMARY OF THE INVENTION

The present invention relates to installing in-ground support footings around upstanding elongate objects such as structural poles, post, pilings and the like, to enhance structural integrity thereof, and more particularly to a novel method, apparatus and assembly for installing a cylindrical casing around subterranean and above-ground portions of an elongate object without the necessity for cutting, moving or otherwise disturbing the elongate object.

The present invention is directed to providing support footings for any type of existing ground-supported elongate object, however, the present invention is particularly suited for reestablishing adequate structural support to deteriorated or damaged utility poles and power transmission line towers. Utility poles are usually wooden, and may become structurally-weakened and inadequate to support utility lines, such as electrical power lines and telephone lines as well as transformers, etc.,—an obviously unsafe condition. Deterioration often occurs in utility poles after they have been disposed in the ground for several years, and "groundline rot" caused by moisture, insects and fungi, may extend in poles from just above the ground and thereinto up to two feet or thereabouts. The pole is essentially rotting around its ground-supported base and becomes structurally very weak, not only from a column standpoint but also in bending or shear strength.

Utility poles may also become split or fractured and structurally weakened after being struck by livestock (in rural areas) and/or vehicular traffic. Moreover, utility poles located along streets, highways, alleys or other thoroughfares are close to traffic and subject to being hit by automobiles and trucks, and thereby damaged.

Obviously, utility poles weakened by groundline rot or fracture present a dangerous situation which is to be avoided—and various techniques have been proposed and practiced to prevent weakened or damaged utility poles from becoming toppled.

The most basic technique involves replacement of a deteriorated or damaged utility pole with a new pole. This technique requires that the utility lines be disconnected from the top of the pole—resulting in discontinuance of service. The pole is then held by some type of grapple or other device, and is cut at its base. The pole is then removed, the underlying stump dug up, and a new pole is repositioned in the same hole from which the stump was removed, because the lines must be supported at the same general location, when reinstalled on the new pole. It can be appreciated that removal of the old pole and transport of the new pole for replacement are time-consuming and expensive steps in and of themselves. Furthermore, because of the nation's dwindling timber resources and environmental pressures, replacement poles are difficult to procure and expensive.

In an atttempt to answer the basic problems attendant with the replacement pole technique, it has been proposed to strengthen an existing, structurally-weakened pole by "stubbing" the pole and providing an in-ground support footing defined by a grout-filled casing. The "stubbing" technique requires that the weakened pole be held firmly adjacent its top by means of some type of boom assembly. The pole is then "stubbed" by cutting the pole off at its base or butt by means of a chain saw or other cutting device. The boom is then operated to hold and shift the pole to the side of the stump or "stub," and this may be difficult to do without disturbing the line connections. Next, an anchoring system is employed requiring a specialized apparatus including a rotatable driver mounted for rotating a casing over the stub. The casing is secured at its top edge to a rotatable driver, and the casing may be thought of as a large helical thread. The casing has a diameter greater than that of the pole and it is rotated and driven down around the stub for a predetermined distance, so that the casing surrounds the damaged area of the "stub," i.e., until the top of the casing is positioned one foot or thereabouts above the ground.

Next, the rotation device is uncoupled from the top of the casing and an upwardly extending sleeve is attached thereto. The remainder portion of the pole, which has been held continuously by a crane or boom, is then inserted into the sleeve until its bottom engages the top of the "stub." Thereafter, grout and sand is dispensed into the annulus between the interior walls of the casing and the "stub" and upwardly into the annulus defined between the interior walls of the sleeve and the pole. It should be appreciated that the stubbing technique suffers from several significant drawbacks, namely, the pole must be cut and supported by a boom and shifted to one side, possibly requiring disconnecting of lines, with the consequent discontinuance of service. In addition, the lines must be reconnected and the entire process requiring pole-holding, "stubbing," line disconnect-connect, etc. is time-consuming and expensive.

Another prior-art repair method, also requiring pole cutting or "stubbing," is that known as the "mod pole" technique which proceeds along the following steps. First, a utility pole in need of repair is supported by a stabilizing device, and the pole is then cut off above the ground line. The pole is moved to the side of the "stub" by the stabilizing device and the utility lines are temporarily disconnected from service. Next, the "stub" is removed and a prestressed concrete pole base is implanted in the cleaned-out void left by the original pole. Alternatively, if it is desired to move the pole to a new position, a new hole must be dug. A prestressed, concrete pole replacement base is implanted in the cleaned-out void or new hole, as the case may be, and the supported pole is then moved for attachment to the replacement base. Afer this procedure has been completed, service is reconnected.

All of the above-described repair techniques contemplate that utility poles must be modified in some manner, i.e., by complete replacement or "stubbing," and it is apparent that a technique for establishing an in-ground footing around a utility pole, without replacing, cutting or otherwise modifying that pole would provide significant advantages.

Accordingly, it is a general object of the present invention to provide a novel casing means for installation as an in-ground support footing around a pole by using a method and apparatus which does not require removal or "stubbing" of the pole. More specifically, the present invention is directed to a method and apparatus for installing the casing means which contemplates positioning the casing means, which includes helical thread means at a lower end thereof, for assembly as a hollow, cylindrical casing around the pole. The casing means includes separate components, such as partial or half-cylinders complementary for being moved toward one another laterally inwardly toward the pole and assembled in a cylindrical and unitary final configuration surrounding the above-ground lower region of the pole. The casing means is then gripped by an assembly or apparatus of the present invention and rotated about its longitudinal axis so that it is driven into the ground for creating a relatively soil-free annulus between the casing means and the corresponding exterior surface of the pole. Suitable stabilizing filler material such as grout is then dispensed into a substantial portion of the annulus. The result is a repaired pole having a footing providing substantial strength which completely surrounds the deteriorated or damaged portion of the pole—accomplished without moving or cutting the pole.

Another object of the present invention is to provide an apparatus for cooperating with the casing means for installing same by driving it into the ground in an efficient manner, maintaining substantial concentricity between the longitudinal axes of the casing means and the elongate object or pole. Specifically, the apparatus of the present invention is directed to a driver means which is positionable about a circumferential portion of the casing means at the lower, above-ground region of the pole for engaging the casing means and rotating it about its longitudinal axis while simultaneously imparting a downwardly-directed force against the upper edge of the casing means thereby accomplishing the driving of the casing means into the ground to a predetermined depth.

Still another object of the present invention is to provide a driver means, as described above, with a special configuration which permits the driver means to be moved laterally toward the pole, thereby enabling the pole to be maintained as an integral unit with its attached lines. The novel configuration of the driver means is defined by a pair of jaw members which are pivotally interconnected adjacent one set of their ends and are openable for receiving the casing means therebetween and closable for surrounding the circumferential portion of the casing means to establish an operative drive mode for rotating the casing means and directing it ddownwardly into the ground.

A still further object of the present invention is to provide each of the above-described jaw members with a rotatable means operable for engaging the casing means and rotating it when the jaw members are disposed in the closed position, and power-driven means operatively coupled to the rotatable means for imparting rotation thereto. To accomplish this type of driver means construction, the rotatable means is defined by first and second half-cylinder shells, mounted respectively in the first and second jaw members. Each of the shells is oriented relative to one another to mate coaxially with the other, when the jaw members are disposed in the closed position, to define a rotatable cylinder dimensioned with a diameter greater than that of the casing means adapted for engaging the casing means and imparting rotation thereto.

Yet another object of the present invention is to provide transmission means operatively coupling the power-driven means to each half-cylinder shell for imparting rotation thereto when the jaw members are disposed in the closed position. The transmission means is defined by a pair of ring gear segments, one being slidably and rotatably mounted in each jaw member and secured to an associated half-cylinder shell. When the jaw members are disposed in the closed position, the ring gear segments become interconnected and complementary to form a continuous ring gear. Each of the half-cylinder shells is thereby rotated when the power-driven means is operated and includes a transfer means for engaging the casing means and imparting transferred rotation from the power-driven means to the casing means.

A still further object of the present invention is to provide a specific casing means configuration uniquely adapted for engagement with the transfer means mounted on the half-cylinder shells which have been described above. Specifically, the casing means is defined by a first cylindrical half-section conjoinable for assembly with a complementary cylindrical half-section so that an elongate longitudinal edge of each half-section overlaps a sidewall portion of the other half-section. The result is a pair of edges which may be engaged by the transfer means mounted on the half-cylinder shells so that rotation of the half-cylinder shells imparts rotation to the casing means.

A further object of the present invention is to provide an overall assembly for supporting the driver means and enabling selective positioning of the driver means. The assembly includes a boom assembly adapted to be mounted on a supporting structure, such as a vehicle, including an extendable-retractable boom arm adjustable for being selectively positioned so that the end of the boom arm, which supports the driver means, may be oriented at a preselected position relative to the ground. A mast assembly defining a mounting rack is supported on the end of the boom arm and holds the driver means, and a shifting means associated with the mast assembly is coupled to the driver means selectively operable for rectilinearly shifting the driver means therealong. The shifting of the driver means is necessary for imparting a downwardly-directed force to the casing means, when the jaw members are disposed in the closed position during rotation of the half-cylinder shells for driving the casing means into the ground.

A still further object of the present invention is to provide an assembly, as described above, which includes stabilizing means supported on the mast assembly disposed at an elevation above the driver means selectively operable for gripping and stabilizing the elongate object from substantial rotational movement during operation of the driver means in the drive mode.

These and additional objects and advantages of the present invention will be more readily understood after a consideration of the brief description of the drawings and the following detailed description of the preferred embodiments.

DETAILED DESCRIPTION OF THE PREFERRED EMBODIMENTS

The present invention is directed to a novel casing means and also to a driver means operable for driving the casing means into the ground for installing an in-ground support footing around subterranean and above-ground portions of an upstanding elongate object, such as a structural pole, post or the like, to enhance structural integrity thereof without removing, cutting or otherwise modifying or shifting the pole. The following description initially will set forth the structure of the casing means, and then proceed with an outline of an assembly for orienting a driver means for driving the casing means into the ground.

Figure 1:
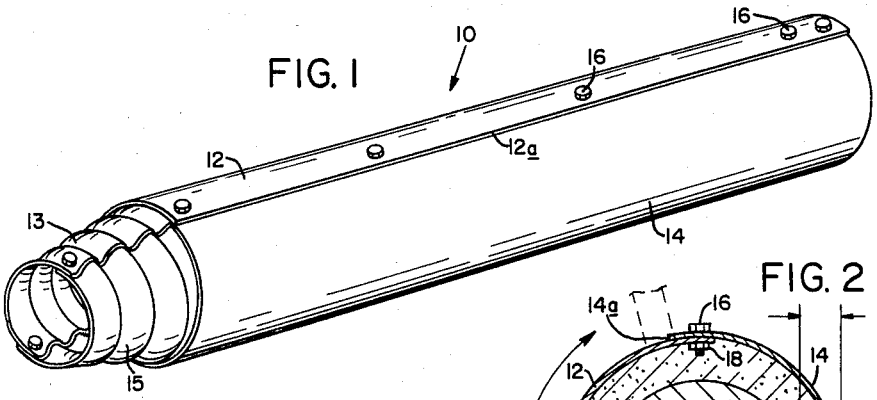
FIG. 1 is a perspective view of a casing means according to the present invention shown in an assembled configuration.
Figure 2:
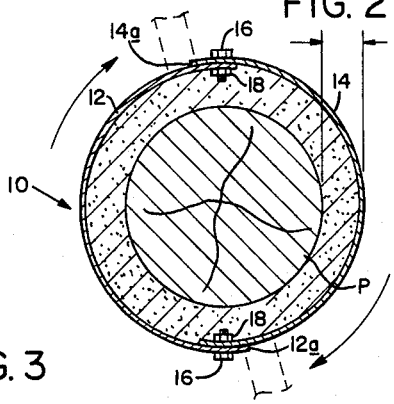
FIG. 2 is a cross section of the casing means illustrating how the casing means half-sections may be interconnected and coaxially positioned around an elongate object such as a utility pole.

Turning now to FIG. 1, there is indicated generally at 10 a casing means, shown in an assembled configuration, in accordance with the present invention. Casing means 10 is a "split casing" and includes multiple components, namely, first and second partial cylinders, such as complementary cylindrical half-sections 12, 14, each of which is provided with corresponding downwardly tapering, partial helical thread means such as indicated at 12*a*, 14*a*, respectively. As shown in FIGS. 1 and 2, the half-sections are substantially identical and dimensioned with the same general predetermined radius as one another. The half-sections are complementary and conjoinable for assembly around a pole so that an elongate longitudinal edge of each half-section overlaps a sidewall portion of the other half-section.

Specifically, it can be seen in FIG. 2—which is a view showing the half-sections assembled around a pole—that half-section 12 overlaps half-section 14 so that a longitudinal edge 12*a* is presented. Similarly, half-section 14 overlaps, at a diametrically opposed position, half-section 12 so that a longitudinal edge 14*a* is presented on the opposite side. Fastening means, such as indicated at 16, are disposed through suitable apertures in each of the half-sections for securing to fastener-receiving means, such as nuts 18 which are secured, as by swaging on an internal wall thereof. The fastening means are spaced-apart longitudinally as shown in FIG. 1, and are also used to conjoin helical thread sections 13, 15 as also illustrated.

Figure 3:
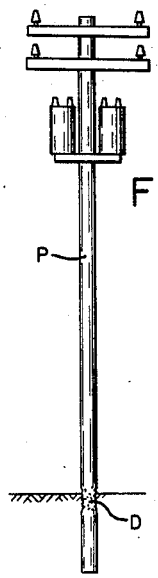
FIG. 3 is a general view of a utility pole shown mounted in the ground with a schematic representation of groundline rot.
Figure 4:
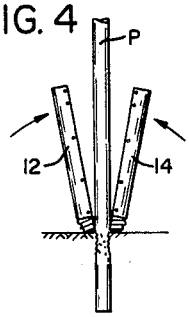
FIG. 4 is a reduced view of the casing means of FIG. 1, shown in its disassembled configuration, being positioned laterally around a circumferential portion of the pole.

The casing means is provided to define an in-ground support footing around an elongate object such as a utility pole or the like indicated at P shown in FIG. 3. As mentioned previously, the intent of the present invention is to provide an in-ground support footing without disturbing the pole, and the casing means of the present invention, being constructed of separable components, facilitates initial positioning of the casing means to define a cylinder of hollow construction, concentrically positionable around a lower, above-ground region of pole P. As shown in FIG. 4, half-sections 12, 14, with their respective helical thread means, which may be thought of as a cutting means, are positionable from a disassembled configuration with their concave inner wall surfaces facing pole P and movable laterally toward the pole for assembly as a cylinder in a unitary, final configuration surrounding the pole and defining an annulus between the inner wall surfaces of the half-sections and a portion of the corresponding exterior surface of the pole.

Figure 6:
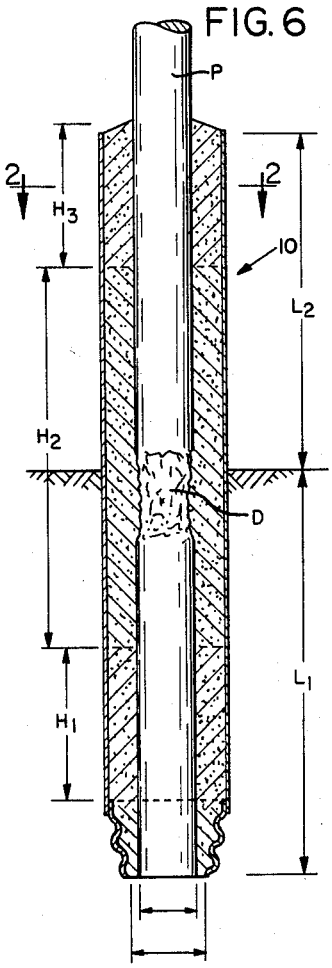
FIG. 6 is an enlarged view of an assembled casing means, shown in longitudinal cross section, after the casing means has been threaded into the ground and filled with grout to surround subterranean and above-ground portions of the pole.
Figure 5:
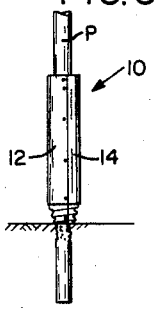
FIG. 5 is a view illustrating the half-sections assembled around the pole.

With casing means 10 positioned as shown in FIG. 5, the fastening means are then utilized to secure the half-sections together. Next, it is necessary to drive the casing means downwardly into the ground to surround a deteriorated or damaged region D of the pole and provide the aforementioned annulus into which suitable filler material, such as grout, may be dispensed for providing the final footing as shown in FIG. 6. The present invention incorporates a novel driver means, which will now be described, for driving casing means 10 into the ground to provide a support footing around subterranean and above-ground portions of pole P.

Figures 9, 10, 11:
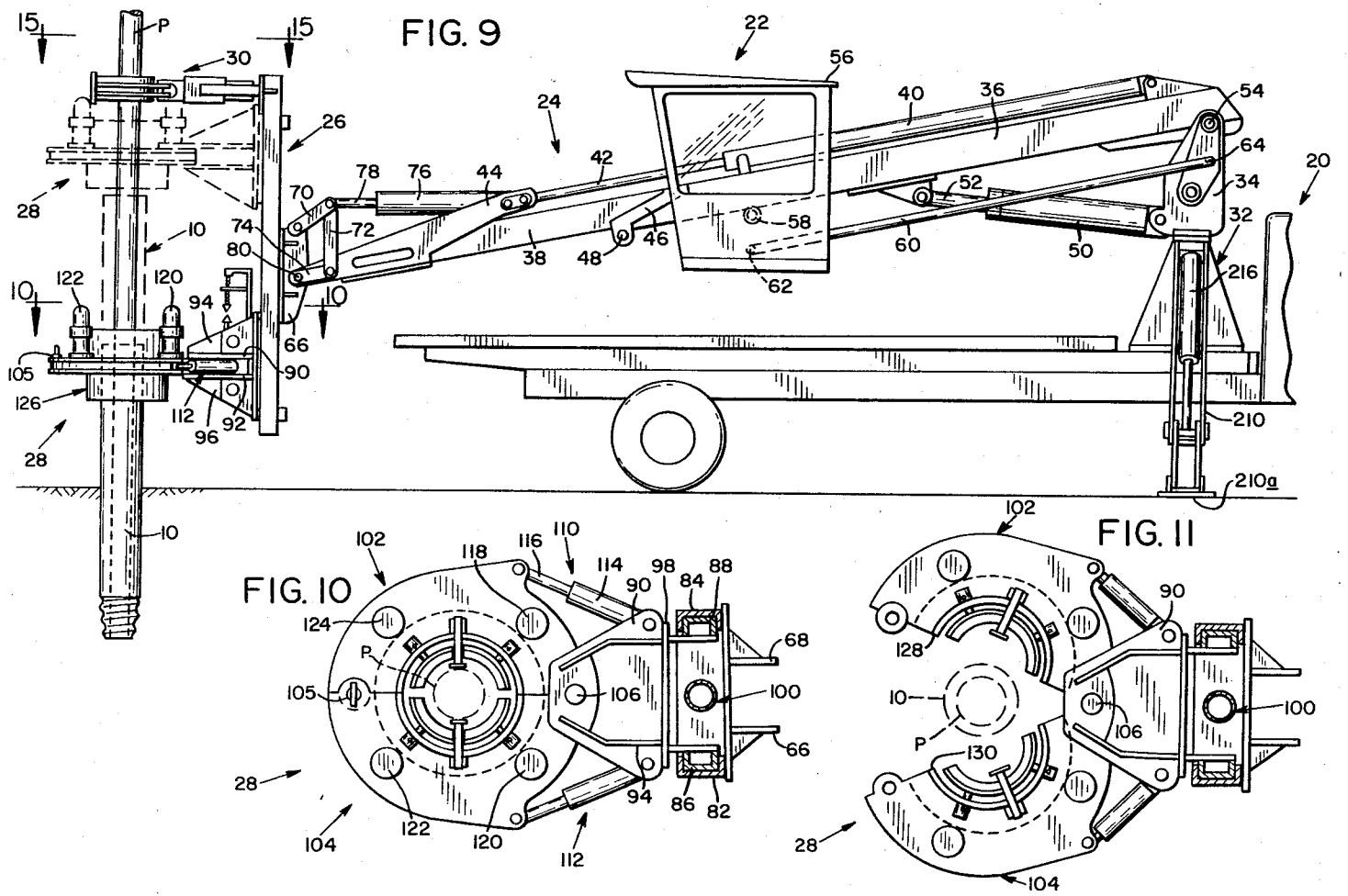
FIG. 9 is a side elevational view of a boom assembly, shown mounted on a vehicle, interconnected to a mast assembly which supports a drive means and a stabilizing means in accordance with the present invention, the driver means being shown in preoperative and operative positions for driving the casing means into the ground.
FIG. 10 is a top plan elevational view of the driver means and supporting structure taken along lines 10—10 of FIG. 9 showing the jaw members of the driver means in the closed position.
FIG. 11 is a top plan view of the driver means, similar to that shown in FIG. 10, illustrating the jaw members disposed in the open position.

Specifically, with reference now directed to FIG. 9, a vehicle 20 is shown with an orienting or positioning assembly, generally indicated at 22, including various components operable for engaging casing means 10 and driving it into the ground. Assembly 22 is defined by a boom assembly, generally indicated at 24 which is provided with a mast assembly defining a tool or mounting rack, generally indicated at 26, for holding a driver means generally indicated at 28, as well as a stabilizing means generally indicated at 30. With respect to boom assembly 24, it will be seen that it includes a first main support indicated at 32 which supports a swivel mount 34 disposed at a fore end of the bed of vehicle 20. Swivel mount 34 may be rotatably swung about a vertical axis by suitable positioning means, such as a fluid-actuated cylinder and rod (not shown) for selectively swinging a main boom tube 36 and a slider tube or boom arm 38. A fluid-powered cylinder 40 mounted on top of boom tube 36 is provided for selectively extending and retracting a rod 42 which, in turn, is connected to a positioner plate or mount 44 connected to an end of boom arm 38. The boom arm is, therefore, extendable-retractable and slidably received within main boom tube 36 adjustable for being selectively positioned so that the end of the boom arm may be oriented at a preselected position relative to the ground. A roller support 46 is secured to main boom tube 36 for holding a roller 48 which engages the bottom of boom arm 38 and facilitates its movement during extension and retraction relative to main boom tube 36.

A first tilting means including a fluid-powered cylinder 50 is connected to swivel mount 34 and is operable for selectively extending and retracting an associated rod 52 secured to a bottom of main boom tube 36 for tilting the main boom tube and boom arm about a horizontal tilt axis indicated at 54. In addition, an operator's cab shown at 56 is pivotally connected by means of swing pin indicated at 52 to main boom tube 36. A leveling bar, such as shown at 60, is pivotally connected at 62 to cab 56 and at 64 to swivel mount 34. The leveling bar and main boom tube 36 are positioned relative to one another so that a parallel bar linkage system is defined. Thus, upon selected positioning of main boom tube 36 relative to the ground, the cab will always be maintained in a horizontal position. The cab is provided with suitable controls (not shown) interconnected to a fluid-power supply, such as a hydraulic pump, and other controls for operating the fluid-powered cylinders described. In addition, the cab includes other controls for suitably operating fluid-powered cylinders via suitable connecting lines, valves, etc. to other power sources to be described hereinafter.

Turning now to the aft end of the vehicle or the distal end of boom arm 38, attention will now be directed to mast assembly 26 and then to driver means 28. The mast assembly defines a mounting rack supported on the end of boom arm 38 for holding driver means 28 and is securred to a pair of positioner flanges, one of which is shown at 66 in FIG. 9 and the other at 68 in FIG. 10. The flanges are in turn secured to links 70, 72 and 74. A fluid-powered positioner cylinder, indicated at 76, is operable for selectively extending and retracting a rod 78 which serves to pivot the flanges and mast assembly 26 about a pivot axis 80. While mast assembly 26 is shown positioned substantially vertically in FIG. 9, it should be appreciated that it may be pivoted about axis 80 in a counterclockwise direction so that upon suitable upward tilting of main boom tube 36 and retraction of boom arm 38, the bottom of mast assembly 26 may be brought to rest on the bed of vehicle 20 for transport.

Mast assembly 26 includes a pair of guide channels, such as indicated at 82, 84 (see FIG. 10) for receiving inner slide frame members 86, 88, respectively. The inner slide frame members are joined to a pair of vertically spaced-apart, horizontal mounting plates such as indicated at 90, 92. The plates are supported by gusset braces above and below such as shown at 94, 96 in FIG. 9. Mounting plates 90, 92 are secured to a back support plate 98 which in turn is suitably rigidly connected to slide frame members 86, 88. A shifting means, generally indicated at 100, is mounted to the mast assembly and is operable for shifting mounting plates 90, 92 and attendant structure, such as driver means 28, rectilinearly therealong to a preselected position.

Turning now to the specifics of driver means 28, attention is directed to FIGS. 10 and 11, as well as FIG. 9. The driver means is defined by first and second drive sections, such as first and second jaw members indicated generally at 102, 104 which are movable relative to one another from an inoperative first, open position (see FIG. 11) for receiving the casing means therebetween to a second, closed position—shown in FIGS. 9 and 10—surrounding a circumferential portion of the casing means, thereby establishing an operative drive mode for rotating the casing means and directing it downwardly into the ground. A locking pin is shown at 105 for holding the jaw members in a closed position as illustrated in FIG. 10. The first and second jaw members are pivotally connected adjacent one set of their ends by a pivot pin 106 which extends through mounting plates 90, 92. A pair of clamping or actuating means, indicated at 110, 112 are connected to jaw members 102, 104, respectively, and mounting plates 90, 92, operable for arcuately swinging opposite ends of the jaw members toward and away from one another from the open and closed positions as shown in FIGS. 10 and 11. Each actuating means, such as that indicated at 110, includes a fluid-powered cylinder 114, operable for extending and retracting a rod 116 which is connected to a jaw member lug extension such as is shown.

Figure 13:
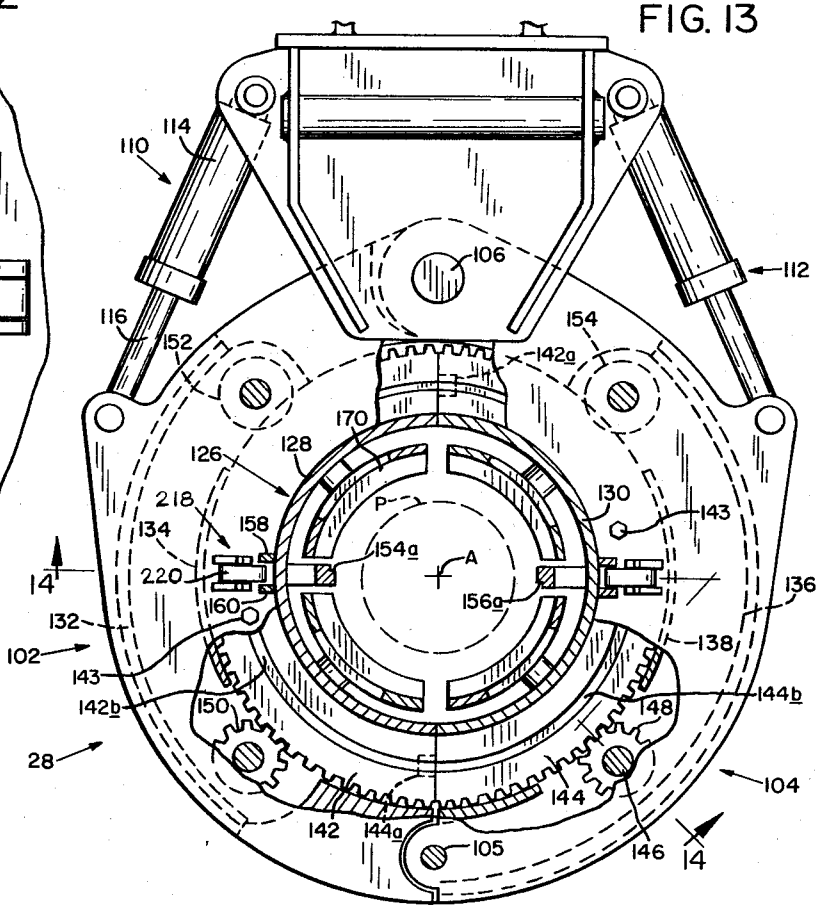
FIG. 13 is an enlarged view of the driver means of FIG. 10, also rotated 90°.

Each of the jaw members is provided with rotatable means operable for engaging the casing means and rotating it when the jaw members are disposed in the closed position. Power-driven means, such as motors 118–124 are mounted on the jaw members and are operatively coupled to the rotatable means for imparting rotation thereto via a structure to be hereinafter described. Specifically, FIG. 13 illustrates driver means 28—rotated 90° from FIGS. 10 and 11 for clarity—with jaw members 102, 104 disposed in the closed position, and it can be seen that a rotatable means generally indicated at 126 defines a cylinder which is mounted for rotation in the jaw members. The rotatable means is defined by a pair of components, namely, a first shell, dimensioned as a half-cylinder indicated at 128 and a second shell, also dimensioned as a half-cylinder indicated at 130. The shells are shown separated from one another when disposed in the open position as shown in FIG. 11.

Figure 14:
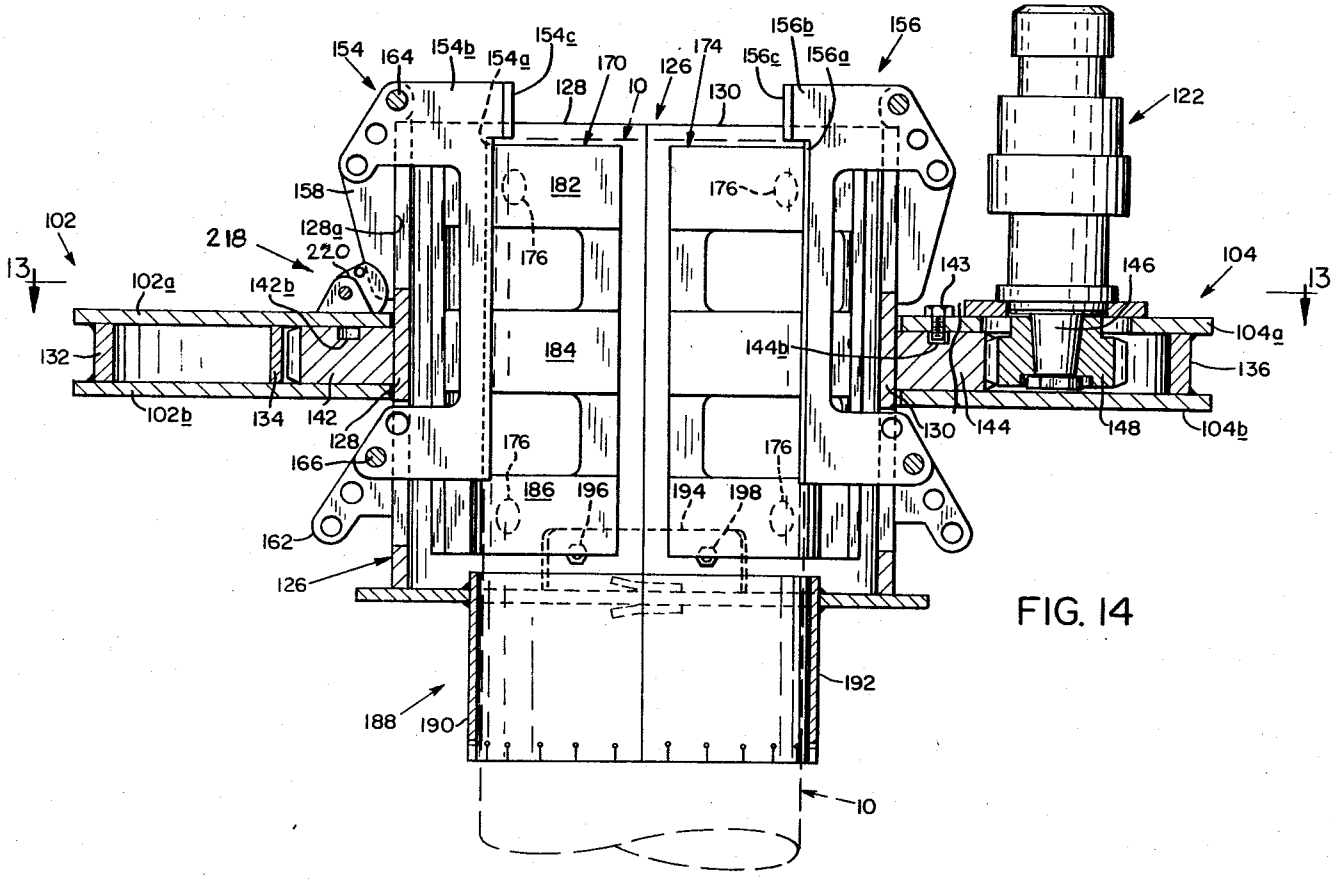
FIG. 14 is an enlarged cross-sectional view of the driver means taken along lines 14—14 of FIG. 13.

Returning to FIG. 13 (see also FIG. 12), it can be seen that when jaw members 102, 104 are disposed in the closed position, half-cylinders 128, 130 are oriented relative to one another to mate coaxially to define a rotatable cylinder dimensioned with a diameter greater than that of casing means 10. The rotatable means is adapted for engaging the casing means and imparting rotation thereto. As shown in FIG. 14, which is a cross-sectional view taken along lines 14—14 of FIG. 13, each of the jaw members includes a pair of spaced-apart plates such as indicated at 102*a*, 102*b* for jaw member 102, and at 104*a*, 104*b* for jaw member 104. Plates 102*a*, 102*b* are supported in a spaced-apart manner by means of upstanding, arcuately configured spacers 132, 134—likewise, plates 104*a*, 104*b* are supported in a spaced-apart manner by means of upstanding, arcuately configured spacers 136, 138 (see FIGS. 13 and 14).

The power-driven means, such as motors 118–124 are mounted on the jaw member plates, as can be seen from a consideration of FIG. 14, which shows motor 122 mounted on plate 104*a* of jaw member 104. The motors are operatively coupled to a transmission means for imparting rotation to rotatable cylinder 126, when the jaw members are in the closed position, about a longitudinal axis generally concentric with the longitudinal axes of the casing means and the pole. That axis is designated at A in FIGS. 12 and 13. The transmission means can be seen from a viewing of FIG. 13 which shows a first ring gear segment 142 mounted in jaw member 102 and a second ring gear segment 114 mounted in jaw member 104. Each of the ring gear segments is slidably and rotatably mounted in an associated jaw member and are interconnectible and complementary to form a continuous ring gear fixed by means of dowels shown at 142*a*, 144*a* when the jaw members are disposed in the closed position as shown in FIG. 13.

Each of the ring gear segments is rigidly connected to an associated one of the half-cylinders as shown in FIG. 14. Specifically, ring gear segment 142 is secured to half-cylinder 128 (as by weldments) and ring gear segment 144 is shown secured to half-cylinder 130. Thus, it an be appreciated that as the ring gear segments are rotated when the jaw members are in the closed position, rotation is simultaneously imparted to the half-cylinders (formed as a cylinder) which define the rotatable means. Each ring gear segment, being ragidly connected to an associated half-cylinder, defines a ring gear segment-half-cylinder unit movable toward and away from one another during corresponding pivotal movement of the jaw members. The ring gear segments are generally maintained in position by bolts 143, mounted in the upper plates of the jaw members for reception in arcuate guides 142*b*, 144*b* formed in ring gear segments 142, 144, respectively.

With respect to imparting rotation to the ring gear segments, and what would correspond to the continuous ring gear when the jar members are closed, it can be seen from a consideration of FIG. 14 that motor 122 (the other motors being similar) includes a shaft 146 secured to a pinion gear 148 disposed for meshing with ring gear segment 144. Similarly, additional pinion gears such as indicated at 150, 152 and 154 mesh with the ring gear segments and serve to drive the ring gear segments so that each travels successively and continuously from one jaw member to the other as a continuous ring gear when the jaw members are disposed in the closed position and motors 120–124 are driven. The pinion gears, when viewing FIG. 13, are driven in a counterclockwise direction for driving ring gear segments 142, 144 as a continuous ring gear in a clockwise direction.

As mentioned at an earlier point in this description, driver means 28 is constructed so as to drive a casing means such as that indicated at 10 in FIG. 1. The casing means is defined by a pair of complementary cylindrical half-sections which are assembled to define a rigid unit for surrounding the pole with the longitudinal axis of the casing means being substantially concentric with that of the pole. Moreover, each half-section of the casing means has a longitudinal edge overlapping a sidewall portion of the other half-section, and driver means 28 is constructed to transfer rotation from rotatable means 126 (half-cylinder 128, 130) by engaging the longitudinal edges of the casing means. This construction can be best appreciated from a consideration of FIGS. 12 and 13).

Figure 12:
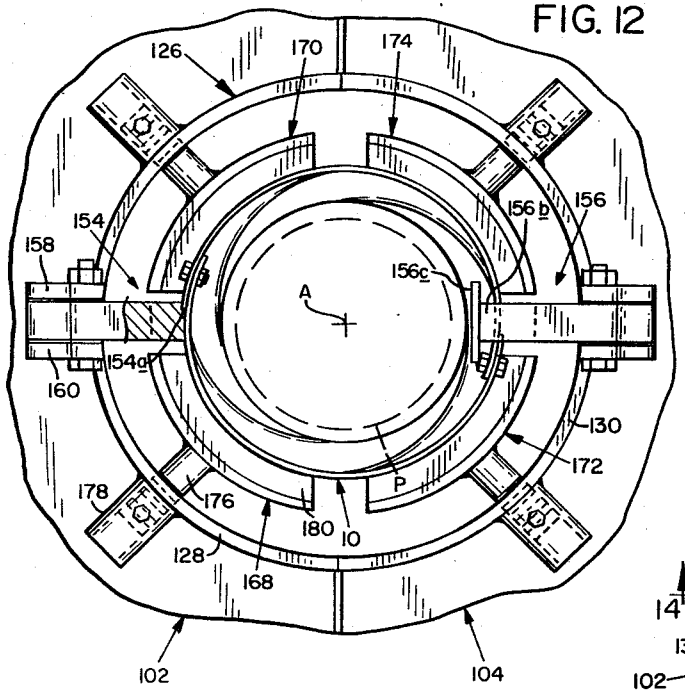
FIG. 12 is an enlarged view of FIG. 10, rotated 90°, showing portions of the driver means.

Referring first to FIG. 12, it can be seen that jaw members 102, 104, disposed in the closed condition, orient rotatable means 126, comprising half-cylinders 128, 130, so as to be positioned concentrically relative to pole P and prepositioned casing means 10. Transfer means, such as elongate dog members generally indicated at 154, 156 are mounted on half-cylinders 128, 130, respectively, in a diametrically opposed position for engaging the longitudinal edges of casing means 10 along a predetermined length thereof for imparting a couple transferred from the half-cylinders (driven by the motors, pinions and continuous ring gear) to the casing means. The dog members can also be seen in FIG. 14, which does not include a viewing of the casing means so that a clear viewing of the dog members can be presented. For instance, dog member 154 is shown as being elongate and substantially vertically disposed between the interior of half-cylinder 128 and what would correspond to be the casing means (see also FIG. 12). Similarly, dog member 156 is mounted on half-cylinder 130. Each of the dog members, such as dog member 154, includes vertically-extending abutment means such as a notch 154*a* for cooperatively receiving and abutting against a longitudinal edge of the casing means over a predetermined length.

The engagement of notch 154*a* against a longitudinal edge of casing means 10 is shown clearly at the left part of FIG. 12. Similarly, oppositely positioned dog member 156 includes a vertically-extending abutment means such as notch 156*a* which also engages the opposite longitudinal edge of casing means 10. Moreover, each dog member includes a laterally-extending means such as inwardly-extending projection 154*b* on dog member 154 for engaging the upper edge of the casing means. Similary, dog member 156 includes inwardly-extending projection 156*b* which engages the upper edge of the cylindrical casing means. The view shown in FIG. 12 depicts dog member 154 with projection 154*b* sectioned away so that the abutment of notch 154*a* against the longitudinal edge of the casing means is presented clearly. However, a viewing to the right of FIG. 12 (as well as FIG. 13) show how projection 156*b* of dog member 156 extends over the upper edge of casing means 10. The reason for the projections is so that driver means 28 may be lowered, during rotation of the casing means, for imparting a downwardy-directed force thereagainst to assist in the driving sequence. Bumper means, such as plates 154*c*, 156*c*, are mounted on dog members 154, 156, respectively, for deflecting their associated laterally-extending means from engagement with the pole during rotation of rotatable means 126.

With respect to the manner of support of the dog members on their respective half-cylinders, it can be seen from a viewing of FIGS. 12 and 13 that each half-cylinder, such as that indicated at 128, is provided with anchor means, such as upwardly-positioned anchor bars 158, 160 which are secured alongside a slot 128*a* (see FIG. 14) for providing an upper mount for dog member 154. The view of FIG. 14 shows anchor bar 158, and anchor bar 160 is not shown for purposes of clarity. Similarly, bottom anchor bars such as that shown at 162 (the other one being deleted) serve to mount the bottom part of dog member 154. The anchor bars each include a series of diagonally placed apertures which are alignable with corresponding apertures provided in the dog members. For instance, viewing dog member 154 in FIG. 14, it can be seen that a securing pin 164 interconnects the upper portion of the dog member to the upper anchor bar such as anchor bar 158. Similarly, another pin 166 interconnects aligned apertures in a lower portion of the dog member to lower anchor bar 162. The apertures in each of the anchor bars, which are alignable with apertures in the dog members, provide spaced-apart mounting connections for enabling the dog members to be selectively positioned at radially-variable positions inwardly of the half-cylinder.

The reason for varying the position of the dog members from a radially inward standpoint, is so that the abutment means, such as notches 154*a*, 156*a* may be positioned for engaging casing means of different diameters. Different diameter casing means may be required because of various diameters of elongate objects. For example, utility poles, such as those used for distribution, generally have diameters of 14 inches or 16 inches, while transmission poles have diameters of 21 inches and 24 inches. Because it is necessary to drive casing means 10 into the ground around a pole so that an annulus is provided for the grout material, it is obvious that if poles having various diameters are used, then different diameter casing means must be employed. As such, viewing FIG. 14, it can be seen that if dog members 154, 156 are repositioned so that they are shifted downwardly so that new holes are aligned, then a larger casing means, for accommodating a larger pole, may be driven by the dog members.

Returning again to FIG. 12, it will be seen that half-cylinders 128, 130 are provided with adjustable support means for defining a collar which engages circumferential sidewall portions of the casing means. Explaining further, it can be seen that half-cylinder 128 includes adjustable support means 168, 170 mounted thereon and half-cylinder 130 includes adjustable support means 172, 174 mounted thereon. The adjustable support means engage sidewall portions of casing means 10, such as shown in FIG. 12, during rotation of the rotatable means and corresponding rotation of the casing means for substantially maintaining concentricity of the longitudinal axes of the casing means and the pole about axis A. The adjustable support means are radially inwardly adjustable by means of a slide tube such as that shown at 176 slidably adjustable within a receiving sleeve 178 mounted on half-cylinder 128. The adjustable support means includes arcuately-configured resilient means such as indicated at 180 for engaging sidewall portions of the casing means. As shown in FIG. 14, the adjustable support means includes spaced-apart collar sections of resilient material such as indicated at 182, 184 and 186 for adjustable support means 170. The others are similarly constructed.

As shown in FIG. 14, an auxiliary cylindrical cutter, generally indicated at 188 includes half-cylinder cutter sections 190, 192 which may be suitably bolted to the outside of rotatable means 126 by means of an arcuate mounting plate 194 and suitable fasteners 196, 198. The cutter is an auxiliary device having teeth 200 and is specially adapted for cutting into concrete and blacktop in those situations where it is desired to provide an in-ground support footing for a pole having blacktop or concrete surrounding it. Because cutter 188 is mounted on rotatable means 126, it will rotate therewith and provide cutting action around a pole (prior to assemblage of a casing means) to cut through concrete, blacktop or other hard surface. After surface penetration through a predetermined thickness has been accomplished, the cutter means may be removed and the jaw members then placed around a casing means preassembled around the pole.

Figure 15:
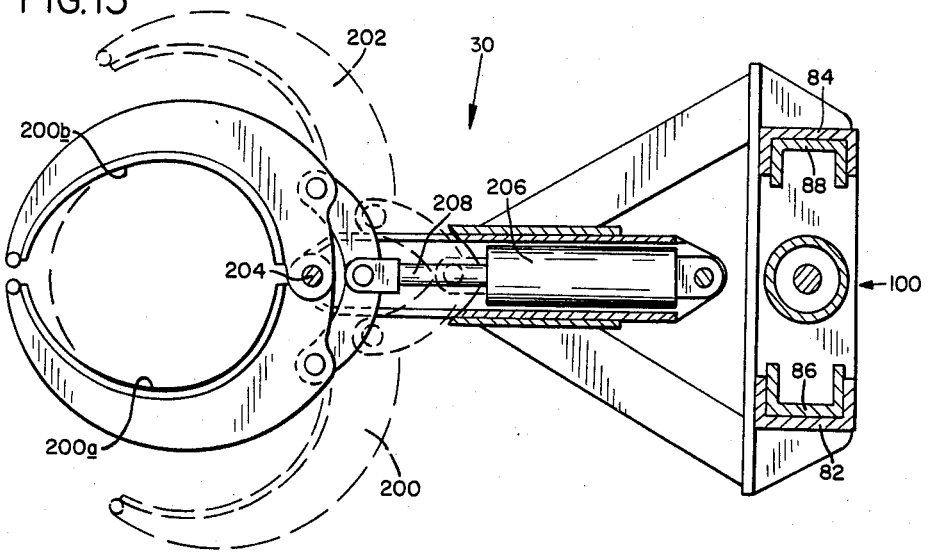
FIG. 15 is a top plan view taken along lines 15—15 of FIG. 9, showing the stabilizing means in closed, clamped configuration and in open configuration in dashed lines.

Turning now to final features of the present invention, attention is directed to FIG. 15 which illustrates, in top plan elevational view, stabilizing means 30 of the present invention. The stabilizing means is supported on the mast assembly and is disposed at an elevation above driver means 20. The stabilizing means includes a pair of clamp arms 200, 202 pivotally interconnected by a pin 204. A fluid-powered means such as a clamping cylinder indicated at 206, is operatively interconnected to a rod 208 for opening and closing, via a linkage assembly, clamp arms 200, 202. It will be noted that each clamp arm is configured with a noncircular, arcuately-configured interior side, such as sides 200*a*, 200*b* on clamp arms 200, 202, respectively, for engaging elongate objects of variable diameters in a rigidly secure, supported manner. The idea is that because poles of different diameters may be encountered during the repair installation technique of the present invention, the clamp arms, which stabilize the pole from substantial rotational and twisting movement, must be configured for engaging a substantial circumferential region of the pole. Accordingly, the noncircular elliptical shape of the interior sides of the clamp arms has been found to be particularly efficient in securely gripping or grasping poles of variable diameters.

Figure 16:
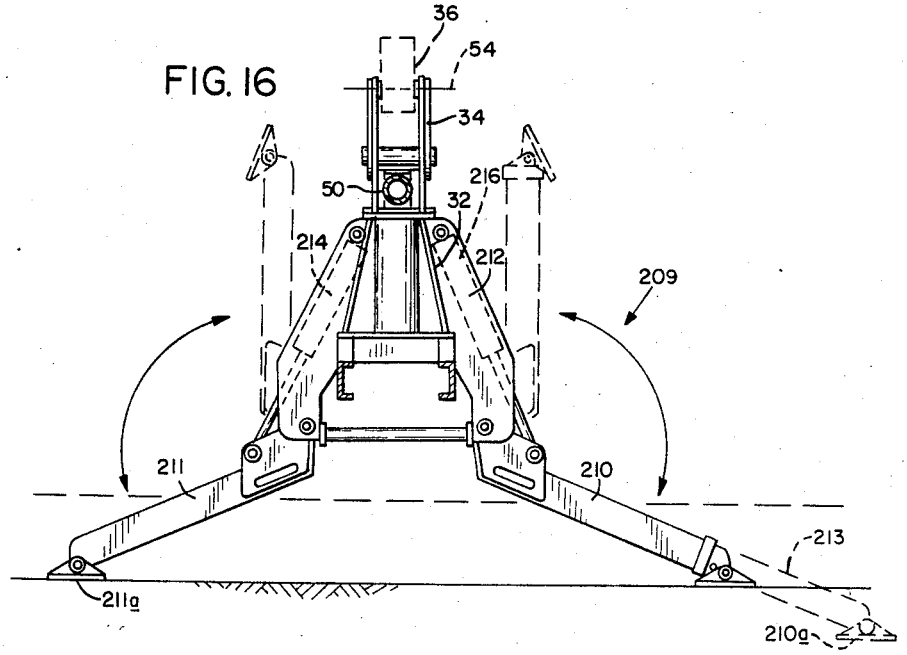
FIG. 16 is a view of an outrigger assembly for positioning the swing axis of the boom assembly in a vertical orientation.

With respect to stabilizing boom assembly 24 (see FIG. 9), and in particular stabilizing swivel mount 34 and orienting it substantially vertically to the ground so that it may be swung about a vertical axis, there is provided (see FIG. 16) an outrigger assembly, generally indicated at 209. The outrigger assembly includes a pair of outrigger legs, 210, 211 (see also FIG. 9) provided with suitable ground-engaging feet such as indicated at 210*a*, 211*a*. Each of the legs is pivotaly connected to a supporting structure such as indicated at 212, which, in turn, is mounted on the bed of vehicle 20. A pair of actuating cylinders 214, 216 are operable for extending legs 210, 211 from a stowed position (shown in dashed lines) to a deployed position as shown in FIG. 16. In addition, leg 210 includes an inner leg 213 which may be selectively extended or retracted for providing additional capability for stability on uneven terrain.

INSTALLATION OF THE CASING MEANS

With the above overall general description of the apparatus and assembly of the driver means and casing means being kept in mind, the following description will now set forth the specific method for installing an in-ground support footing utilizing the casing-driver assembly of the present invention. First of all, referring to FIG. 4, a suitably-sized casing means is assembled around pole P. This is accomplished by manually positioning each half-section of the casing means, such as half-sections 12, 14 laterally toward pole P around a lower, above-ground region of the pole so that the helical thread means engage the ground at ground line. The half-sections are thereby assembled, using the fastening means such as indicated at 16, 18 (see FIG. 2) into a cylindrical and unitary final configuration surrounding the pole at the above-ground lower region as shown in FIG. 5. Thus, the casing means defines a hollow construction generally oriented in a manner so that it is concentrically positionable around the pole, and it is now necessary to drive the casing means into the ground.

In order to accomplish this, the following steps generally are taken. The mast assembly, stowed on the end of the bed of vehicle 20, must be disposed adjacent the casing means. Thus, vehicle 20 is positioned or backed up toward the location of assembled casing means 10 on pole P. As shown in FIG. 9, the outrigger assembly is positioned by an operator in the cab, handling suitable controls, for orienting the vertical or swing axis of swivel mount 34 substantially vertically. Cylinder 50 now is actuated so as to lift the bottom of mast assembly 26 from the upper surface of the truck of the vehicle. The attitude adjustment, namely, cylinder 76, is suitably actuated so as to substantially vertically position mast assembly 26. It is presumed that neither stabilizing means 30 nor driver means 28 is disposed in position for operation. The driver means is then moved upwardly by means of shifting means 100 until it is disposed beneath stabilizing means 30. At this point, the operator in the cab actuates stabilizing means so that cylinder 206 (see FIG. 15) retracts rod 208 thereby opening up clamp arms 200, 202. A worker on the ground then removes locking pin 105 and the cab-mounted operator actuates the controls for actuating means 110, 112 to open jaw members 102, 104 as shown in FIG. 11. Shifting means 100 is then actuated to shift driver means 28 upwardly so it is positioned beneath stabilizing means 30.

The operator then actuates cylinder 40 so as to extend mast assembly 26, driver means 28 and stabilizing means 30 toward pole P. It is understood that cylinder 50 has been previously set so as to raise main boom tube 36 to a height so that the bottom of the driver means is disposed above the top of prepositioned casing means 10 (shown in dashed outline in FIG. 9). With clamp arms 200, 202 and jaw members 102, 104 disposed in their open positions, mast assembly 26 is positioned so that stabilizing means 30 is oriented as shown in FIG. 9 with driver means 28 positioned immediately therebeneath but above casing means 10. This initial position is shown in dashed lines for casing 10 and driver means 28. The operator then actuates positioning cylinder 76 so as to orient mast assembly 26 in a substantially vertical orientation. The vertical orientation can be determined from observing when leveling pointers (a plumb-bob device) are aligned. At this point, the operator then actuates cylinder 206 so as to extend rod 208 of stabilizing means 38 so that clamp arms 200, 202 engage pole P for gripping and stabilizing it from substantial rotational movement.

Next, the operator actuates shifting means 100 so as to shift driver means 28, with its jaw members 102, 104 in the open position, through a down phase until a position is reached whereby projections 154*a*, 156*a* of dog members 154, 156, respectively, are positioned to engage the upper edge of casing means 10. Thereafter, the actuating means, such as indicated at 112, 114 are operated so as to pivotally swing jaw members 102, 104 about hinge 106 until the jaw members are disposed in the closed position, after which locking pin 105 is inserted. In this position, as shown in FIGS. 12 and 13, notches 154*a*, 156*a* on dog members 154, 156 may not quite be engaged with respective overlapped longitudinal edges of casing means 10. Motors 118–124 are actuated so as to rotate the continuous ring gear which is formed by ring gear segments 142, 144. As the ring gear, which is a transmission means, is rotated, it correspondingly rotates rotatable means 126 and attached dog members 154, 156 until notches 154*a*, 156*a* engage the longitudinal edges of casing means 10. The casing means thereby has rotation imparted thereto, and the rotation is continued in sequence with a downward shifting of shifting means 100—with engagement against the upper edge of casing means 10 by the dog members—to drive casing means 10 into the ground as shown in the solid-outline bottom portion of FIG. 9.

The casing means is driven until it surrounds a damaged or deteriorating region such as indicated at D in FIG. 6. The casing means is sunk to a predetermined depth or level $L_1$ as shown in longitudinal cross section in FIG. 6, with an above-ground level shown at $L_2$. The action of the helical thread means serves to move dirt outwardly from the exterior wall of the helical thread means so as to compact the soil outwardly rather than augering the soil upwardly. Once the casing means is positioned so that it covers a predetermined subterranean and above-ground portion of the pole (as in FIG. 6), rotation of the rotatable means and downward shifting of driver means 28 is concluded. At this point, it is seen that the casing means has been driven into the ground for creating a relatively soil-free annulus, to be filled with stabilizing filler material or grout, between the casing means and the corresponding exterior surface of pole P. The stabilizing filler material is dispensed into a substantial portion of the annulus, and this may be accomplished, in one manner, by filling the lower part of the annulus with an epoxy resin-sand mixture ($H_1$) which cures to a strength several times that of concrete, and the mixture may also contain a time-release fungicide to prevent further decay under the repaired portion of the pole.

As also shown in FIG. 6, an intermediate region of the annulus, such as designated by the height $H_2$ is filled with sand or other type of aggregate and may also have a fungicide for inhibiting further rot introduced concurrently. The upper region of the annulus, such as designated at $H_3$ may then be filled with an epoxy resin-sand mixture for providing an upper stabilizing agrout filling. The epoxy resin-sand mixture may be capped off with a bevel at the top as shown in FIG. 6 to provide a water run-off or shedding surface. After introduction and set-up of the stabilizing material in the annulus as described above, pole P is rigidly stabilized by a support footing of substantial strength which greatly enhances structural integrity of the pole.

What has been described above is a very efficient method for installing an in-ground footing around subterranean and above-ground portions of an elongate object such as pole P. The present invention completely dispatches with the necessity of replacing the pole, as required by prior art methods, or any need for "stubbing" and providing some type of connection for remounting the pole. Rather, the pole is maintained as an integral unit during the entire procedure of installing casing means 10, and no modification is required of the pole's preexisting axial length. All that is required is the positioning of the casing means with its cutting means or helical threads in an assembled configuration around a lower, above-ground region of the pole so that the cutting means engages the ground. The casing means is then rotated about its longitudinal axis so that it is driven into the ground for creating the aforementioned soil-free annulus between the casing means and the corresponding exterior surface of the pole with dispensing of stabilizing filler material into a substantial portion of the annulus, completing the method.

While the length of casing means 10 may vary, depending on the type of pole or damage which may be present, a typical length may be in the range of eight feet or thereabouts, measured from the upper edge of casing means 10 to the bottom edge of the helical thread means. The helical thread means may be dimensioned with a length of approximately one foot. As such, the casing means is driven into the ground so that the bottom of the helical thread means, as shown in FIG. 6, generally corresponds to the bottom of pole P with a substantial portion of the casing means being positioned above ground. A typical subterranean depth of penetration of the casing means may be in the range of three to four feet, indicated at $L_1$, while $L_2$ may range in the area of three to four feet or thereabouts. In any event, the deteriorated area D is completely encapsulated, as would also be any above-ground rot or fracture.

It is also to be noted that the driver means of the present invention cooperates with casing means 10 so that the casing means may be firmly engaged, not only by dog members 154, 156 but also by adjustable stabilizing means 168–174. The generally smooth exterior wall surfaces of the casing means ensure positive engagement by the adjustable stabilizing means. The adjustable stabilizing means, as mentioned above, maintains concentricity of casing means 10, relative to the longitudinal axis A of pole P and also prevents the walls of the casing means from twisting relative to one another about its longitudinal axis.

It will also be observed from a consideration of FIGS. 13 and 14 that locking mechanisms, one of which is indicated generally at 218, are provided for locking rotatable means 126 in place in a preset position so that the ring gear segments are each disposed in a corresponding jaw member half. As shown in FIG. 13, locking means 218 includes a pivotal element 220 pivotally mounted to a pair of brackets positionable for selective swinging between anchor bars 158, 160 to position half-cylinder 128 of rotatable means 126 in a locked position as shown. Pivotal element 220 may be swung in the opposite direction so that half-cylinder 128 and ring gear segment 130 are free for movement, and similarly, a locking mechanism and pivotal element are provided for locking half-cylinder 130 and its corresponding ring gear segment as shown.

The locking mechanism are required for holding the half-cylinders stationary in their respective jaw members so that when pin 105 is removed, prior to placement of the open jaw members around casing means 10, each of the ring gear segments is positioned securely and out of the way during lateral shifting of the jaw members to a position to surround the casing means, as shown in FIG. 11. After the jaw members have been disposed into the closed position, with pin 105 being inserted to hold the jaw members together, the pivotal elements, such as indicates at 220, are swung out of the way so that when the motors are actuated, the ring gear segments are free to be driven and travel successively and continuously from one jaw member to the other as a continuous, unitary ring gear during a driving sequence.

Figure 7:
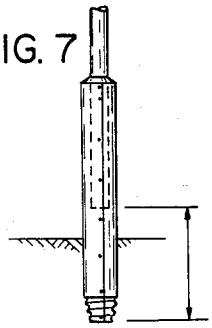
FIG. 7 is a view showing how the casing means may be used to provide a structural footing for a pole which is to be elevated.
Figure 8:
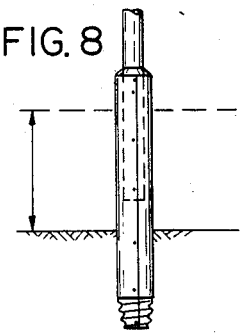
FIG. 8 is a view showing how the casing means may be used to provide a support footing for a pole to be subsequently disposed at a lower elevation.

A further advantage of the casing means and apparatus and assembly for driving same is illustrated in FIGS. 7 and 8. Specifically, referring to FIG. 7, it can be seen that it may be necessary to raise a pole if a new grade line, higher than the previous grade line, is desired to be established. For example, the casing means may be driven suitably into the ground and the stabilizing means, gripping the pole (not shown in FIG. 7) may be elevated, by suitably elevating the mast assembly, so that the pole is rasised within the casing means as shown. Grout may then be dispensed in the annulus for securing the pole in the new, raised elevation which corresponds to the new grade height. Similarly, except that the sequence is oppositely established, a pole may be lowered, as an integral unit, to a new, lower grade line as shown in FIG. 8. The dashed horizontal line shown in FIG. 8 corresponds to a prior grade level and a new grade level, as shown at the bottom, is to be established for a pole. The casing means is driven into the ground to a predetermined depth and then the pole may be lowered into suitable position to correspond to the new grade level.

While the present invention has been shown and described with reference to the foregoing preferred embodiments, it will be apparent to those skilled in the art that changes in form and detail may be made without departing from the scope and spirit of the present invention as defined in the appended claims.

It is claimed and desired to secure by Letters Patent:

1. An assembly for installing an in-ground support footing around subterranean and above-ground portions of an upstanding elongate object, such as a structural pole, post or the like, to enhance structural integrity thereof, comprising:

cylindrical casing means of hollow construction having a cutting means concentrically positionable around a lower, above-ground region of the elongate object so that the cutting means engages the ground; and driver means positionable about a circumferential portion of the casing means operable for engaging the casing means and rotating it about its longitudinal axis while simultaneously imparting a downwardly-directed force against the upper edge of the casing means thereby to drive the casing means into the ground to a predetermined depth, wherein the driver means includes first and second drive sections movable relative to one another from an inoperative first, open position for receiving the casing means therebetween to a second, closed position surrounding a circumferential portion of the casing means, thereby establishing an operative drive mode for rotating the casing means and directing it downwardly into the ground.

2. The assembly of claim 1 wherein the first and second drive sections are defined by first and second jaw members pivotally interconnected adjacent one set of their ends, and actuating means connected to the jaw members operable for arcuately swinging opposite ends of the jaw members toward and away from one another from the open and closed positions.

3. The assembly of claim 2 wherein each jaw member is provided with rotatable means operable for engaging the casing means and rotating it when the jaw members are disposed in the closed position, and power-driven means operatively coupled to the rotatable means for imparting rotation thereto.

4. The assembly of claim 3 wherein the rotatable means includes a first shell, dimensioned as a half-cylinder, rotatably mounted in the first jaw member and a second shell, dimensioned as a half-cylinder, rotatably mounted in the second jaw member, each signal being oriented relative to one another to mate coaxially with the other, when the jaw members are disposed in the closed position, to define a rotatable cylinder dimensioned with a diameter greater than that of the casing means adapted for engaging the casing means and imparting rotation thereto.

5. The assembly of claim 4 further including transmission means operatively coupling the power-driven means to each shell for imparting rotation thereto, when the jaw members are disposed in the closed position, about a longitudinal axis generally concentric with the longitudinal axes of the casing means and the elongate object.

6. The assembly of claim 5 wherein the transmission means is defined by a ring gear segment slidably and rotatably mounted in each jaw member, the ring gear segments being interconnectible and complementary to form a continuous ring gear when the jaw members are disposed in the closed position.

7. The assembly of claim 6 wherein each ring gear segment is defined by a pitch circle arc being one-half that of the pitch circle defined by the continuous ring gear.

8. The assembly of claim 7 wherein each ring gear segment is rigidly connected to an associated one of the shells, to define a pair of ring gear segment-shell units movable toward and away from one another during corresponding pivotal movement of the jaw members.

9. The assembly of claim 8 wherein the continuous ring gear is mounted in the jaw members so that each ring gear segment travels successively and continuously from one jaw member to the other during rotation of the continuous ring gear when the jaw members are disposed in the closed position.

10. The assembly of claim 9 wherein the power-driven means is operatively connected to drive pinion gears disposed of meshing with the ring gear segments.

11. The assembly of claim 10 further including transfer means detachably mounted on at least one of the shells, and movable therewith, for engaging the casing means and imparting transferred rotation from the shell to the casing means.

12. The assembly of claim 11 wherein the transfer means is defined by an elongate dog member substantially vertically disposed between the interior of the shell and the exterior of the casing means for engaging the casing means.

13. The assembly of claim 12 further including anchor means secured to an external sidewall portion of the shell for supporting the dog member, the anchor means being provided with spaced-apart mounting connections for enabling the dog member to be selectively positioned at variable radial positions inwardly from the shell.

14. The assembly of claim 10 wherein the casing means is defined by a pair of complementary cylindrical half-sections assemblable to define a rigid unit for surrounding tne elongate object as a cylinder with its longitudinal axis being substantially concentric with that of the elongate object with an elongate longitudinal edge of each half-section overlapping a sidewall portion of the other half-section.

15. The assembly of claim 14 further including transfer means detachably mounted on each shell, diametrically opposed from one another when the jaw members are disposed in the closed position, for engaging the longitudinal edges of the casing means along a predetermined length thereof and imparting a couple transferred from the shells to the casing means.

16. The assembly of claim 15 wherein each transfer means is defined by an elongate dog member substantially vertically disposed between the interior of its associated shell and the casing means.

17. The assembly of claim 16 wherein each dog member includes a vertically-extending abutment means for cooperatively receiving and abutting against a longitudinal edge of the casing means over the predetermined length, each dog member also including a latterally-extending means for engaging an upper edge of the casing means.

18. The assembly of claim 17 further including anchor means secured to an external sidewall portion of each shell for supporting and permitting adjustment of an associated dog member, each anchor means being provided with spaced-apart mounting connections for enabling an associated dog member to be selectively positioned at radially-variable positions inwardly of the shell.

19. The assembly of claim 18 further including adjustable support means mounted on each shell for defining a collar which engages sidewall portions of the casing means, during rotation of the shells and corresponding rotation of the casing means, for substantially maintaining concentricity of the longitudinal axes of the casing means and the elongate object.

20. The assembly of claim 19 wherein the collar of the adjustable support means includes arcuately-configured resilient means for engaging sidewall portions of the casing means.

21. The assembly of claim 20 wherein the collar of the adjustable support means is defined by quadrant sections, a pair of the sections being mounted on opposite sides of each dog member.

22. The assembly of claim 17 wherein each dog member is provided with bumper means for deflecting the laterally-extending means for engagement with the elongate object during rotation of the rotatable means.

23. The assembly of claim 4 further including a mounting rack positionable above the ground for slidably receiving and supporting the driver means, and shifting means associated with the mounting rack coupled to the driver means selectively operable for rectilinearly shifting the driver means therealong.

24. The assembly of claim 23 further including stabilizing means supported on the mounting rack disposed at an elevation above the driver means selectively operable for gripping and stabilizing the elongate object from substantial rotational movement.

25. The assembly of claim 24 wherein the stabilizing means includes a mechanism defined by clamp arms movable from an open position for receiving laterally the elongate object and a closed position for engaging circumferential portions of the elongate object.

26. The assembly of claim 25 wherein the clamp arms of the stabilizing means have noncircular, arcuately-configured interior sides for engaging elongate objects of various diameters in a rigidly secured, supported manner.

27. An apparatus for installing an in-ground support footing around subterranean and above-ground portions of an upstanding elongate object, such as a structural pole, post or the like, to enhance structural integrity thereof, by driving a cylindrical casing means of hollow construction having a cutting means prepositioned concentrically around a lower, above-ground region of the elongate object with the cutting means engaging the ground, comprising:

driver means positionable about a circumferential portion of the casing means operable for engaging the casing means and rotating it about its longitudinal axis while simultaneously imparting a downwardly-directed force against the upper edge of the casing means thereby to drive it into the ground to a predetermined depth, wherein the driver means includes first and second drive sections movable relative to one another from an inoperative first, open position for receiving the casing means therebetween to a second, closed position surrounding a circumferential portion of the casing means, thereby establishing an operative drive mode for rotating the casing means and directing it downwardly into the ground.

28. The apparatus of claim 27 further including a boom assembly adapted to be mounted on a supporting structure, such as a vehicle, including an extendable-retractable boom arm adjustable for selective positioning so that the end of the boom arm may be oriented at a preselected position relative to the ground, and a mast assembly defining a mounting rack supported on the end of the boom arm for holding the driver means, and shifting means associated with the mast assembly coupled to the driver means selectively operable for rectilinearly shifting the driver means therealong to a predetermined position.

29. The apparatus of claim 28 further including tilt means interconnecting the boom arm and mast assembly selectively operable for positioning the mast assembly and the driver means to a predetermined attitude.

30. The apparatus of claim 29 further including stabilizing means supported on the mast assembly disposed at an elevation above the driver means selectively operable for gripping and stabilizing the elongate object from substantial rotational movement.

31. The apparatus of claim 30 further including an operator's cab mounted on the boom assembly including leveling means interconnecting the cab and the boom assembly for maintaining the cab at a generally level position relative to the ground during movement of the boom assembly.

32. A method for installing an in-ground support footing around subterranean and above-ground portions of an upstanding elongate object, such as a pole, post or the like, to enhance structural integrity thereof, comprising:

maintaining the elongate object as an integral unit without modifying its preexisting axial length;

positioning hollow cylindrical casing means having cutting means around a lower, above-ground region of the elongate object so that the cutting means engages the ground;

rotating the cylindrical casing means about its longitudinal axis and driving it into the ground for creating a relatively soil-free annulus between the casing means and the corresponding exterior surface of the elongate object, wherein the rotating step includes engaging the casing means, when assembled in the final configuration, about external portions thereof, and wherein the driving step includes imparting a downwardly-directed force against the upper cylindrical edge of the casing means; and dispensing stabilizing filler material into a substantial portion of the annulus.

33. The method of claim 32 wherein the positioning step includes conjoining complementary sections of the casing means from a disassembled, noncylindrical first configuration to an assembled, cylindrical and unitary final configuration surrounding the above-ground lower region of the elongate object.

34. The method of claim 33 wherein the conjoining step includes moving the complementary sections from the first configuration laterally toward lower sidewall regions of the elongate object and toward one another into the final configuration.

35. The method of claim 34 including the additional step of stabilizing the elongate object during the rotating and driving step by securing it above the casing means from axial and rotational movement.

36. The method of claim 33 wherein the conjoining step includes assembling a pair of substantially identical complementary cylindrical half-sections so that an elongate longitudinal edge of each half-section overlaps a sidewall portion of the other half-section when assembled in the final configuration.

37. The method of claim 36 wherein the rotating step includes engaging one of the half-section longitudinal edges along a predetermined length thereof for imparting a rotational force to the casing means about its longitudinal axis.

38. The method of claim 37 wherein the rotating step also includes engaging the other half-section's longitudinal edge along a predetermined length thereof for imparting coupled, rotational forces to the casing means.

39. The method of claim 38 wherein the rotating step further includes engaging sidewalls of the casing means, during rotation, for substantially maintaining concentricity of the longitudinal axes of the casing means and the elongate object.

40. The method of claim 39 wherein the engagement of the sidewalls is accomplished by directing forces radially inwardly against the casing means around circumferential portions thereof.

* * * * *